US010844670B2

(12) United States Patent
Nielsen, Jr. et al.

(10) Patent No.: US 10,844,670 B2
(45) Date of Patent: Nov. 24, 2020

(54) COUPLINGS FOR WELL PUMPING COMPONENTS

(71) Applicant: Materion Corporation, Mayfield Heights, OH (US)

(72) Inventors: William D. Nielsen, Jr., Kingwood, TX (US); Diane M. Nielsen, Kingwood, TX (US)

(73) Assignee: MATERION CORPORATION, Mayfield Heights, OH (US)

( * ) Notice: Subject to any disclaimer, the term of this patent is extended or adjusted under 35 U.S.C. 154(b) by 153 days.

(21) Appl. No.: 15/926,784

(22) Filed: Mar. 20, 2018

(65) Prior Publication Data

US 2018/0266190 A1 Sep. 20, 2018

Related U.S. Application Data

(63) Continuation-in-part of application No. 14/633,593, filed on Feb. 27, 2015, now Pat. No. 10,435,955.
(Continued)

(51) Int. Cl.
*E21B 17/042* (2006.01)
*E21B 43/12* (2006.01)

(52) U.S. Cl.
CPC ..... *E21B 17/042* (2013.01); *E21B 43/126* (2013.01)

(58) Field of Classification Search
CPC .. E21B 17/042; E21B 17/0426; E21B 43/126; E21B 43/121; E02D 5/526;
(Continued)

(56) References Cited

U.S. PATENT DOCUMENTS 620,265 A * 2/1899 Windle ..... F16L 15/006 285/45
1,452,937 A * 4/1923 Shaffer ..... E21B 17/0423 294/86.32
(Continued)

FOREIGN PATENT DOCUMENTS

CA 2425091 A1 * 10/2004 ..... F16B 31/021
CA 2469583 A1 * 12/2004 ..... B21C 5/00
(Continued)

OTHER PUBLICATIONS

S. Ilangovan et al, "Effects of Tin on Hardness, Wear Rate and Coefficient of Friction of Case Cu—Ni—Sn Alloys," Journal of Engineering Science and Technology, Feb. 1, 2013, pp. 34-43, vol. 8, No. 1, Amrita School of Engineering, Tamilnadu, India.
(Continued)

*Primary Examiner* — Jennifer H Gay
(74) *Attorney, Agent, or Firm* — Kilpatrick Townsend & Stockton LLP

(57) ABSTRACT

A coupling for joining a downhole pump to a sucker rod string is disclosed. The coupling includes a core having a first end, a central portion, and a second end. The first end and the second end each have an end surface. The first end tapers linearly inwards from the central portion to the first end surface. The second end has a rounded edge along the second end surface. The coupling is made from a spinodally-hardened copper-nickel-tin alloy and has a sliding coefficient of friction of less than 0.4 when measured against carbon steel.

20 Claims, 8 Drawing Sheets

Related U.S. Application Data

(60) Provisional application No. 62/473,792, filed on Mar. 20, 2017, provisional application No. 62/065,275, filed on Oct. 17, 2014, provisional application No. 62/008,324, filed on Jun. 5, 2014.

(58) Field of Classification Search
CPC ..... E02D 5/80–88; E02D 29/0233; E02D 2200/16; F16L 15/002; F16L 15/006; F16L 15/007; Y10T 403/5746
See application file for complete search history.

(56) References Cited

U.S. PATENT DOCUMENTS 1,629,058 A * 5/1927 Wilson ..... F16L 37/2445 285/27
2,049,265 A * 7/1936 Kinney ..... E21B 17/1071 166/241.2
2,563,038 A * 8/1951 Irwin ..... E21B 37/02 166/105
2,690,934 A * 10/1954 Holcombe ..... E21B 17/003 166/241.2
3,201,158 A * 8/1965 Meripol ..... E21B 17/042 403/307
4,139,334 A * 2/1979 Payne ..... E21B 17/00 166/176
4,406,561 A * 9/1983 Ewing ..... E21B 17/00 403/343
4,431,219 A * 2/1984 Brewer ..... E21B 17/0423 285/333
4,484,833 A * 11/1984 Gallagher, Jr. ..... E21B 17/00 403/266
4,602,807 A * 7/1986 Bowers ..... E21B 17/00 285/332.4
4,668,117 A * 5/1987 Bair ..... E21B 17/1042 166/176
4,822,201 A 4/1989 Iwasaki
4,823,456 A * 4/1989 Gray ..... B05D 1/24 166/106
4,905,760 A * 3/1990 Gray ..... B05D 1/24 166/105
5,119,876 A * 6/1992 Sable ..... E21B 17/1071 166/241.2
RE34,467 E * 12/1993 Reeves ..... E21B 17/042 285/334
5,334,268 A * 8/1994 Hermanson ..... C21D 9/08 148/530
6,413,326 B1 * 7/2002 Rallis ..... C23C 8/02 148/220
6,837,643 B2 * 1/2005 Lauder ..... E21B 17/0426 166/241.2
7,647,963 B2 * 1/2010 Carstensen ..... E21B 17/0426 166/176
10,435,955 B2 * 10/2019 Nielsen ..... F16L 15/00
2004/0228679 A1 * 11/2004 Reavis ..... E21B 43/106 403/307
2006/0273601 A1 * 12/2006 Carstensen ..... E21B 17/0426 294/91
2008/0035329 A1 * 2/2008 Carstensen ..... E21B 17/0426 166/176
2012/0074692 A1 * 3/2012 Chelette ..... F16L 15/001 285/333
2012/0211237 A1 * 8/2012 Rich ..... E21B 43/126 166/369
2014/0311633 A1 10/2014 Cribb
2015/0267477 A1 * 9/2015 Nielsen ..... E21B 17/00 175/320
2015/0354287 A1 * 12/2015 Nielsen ..... C22C 9/06 166/242.6
2015/0376996 A1 * 12/2015 Downing ..... F04B 19/22 417/514
2016/0060968 A1 * 3/2016 Xie ..... E21B 17/00 403/361
2016/0237796 A1 * 8/2016 Stachowiak ..... F04B 47/02
2016/0376851 A1 * 12/2016 Morrow ..... E21B 17/0426 403/342
2018/0112503 A1 * 4/2018 Lane ..... E21B 43/127
2018/0163485 A1 * 6/2018 Song ..... E21B 17/042
2018/0266190 A1 * 9/2018 Nielsen, Jr. ..... E21B 17/042
2019/0128075 A1 * 5/2019 Urech ..... E21B 17/08
2019/0242197 A1 * 8/2019 Grensing ..... C22C 9/06
2019/0360279 A1 * 11/2019 Trowbridge ..... E21B 43/126

FOREIGN PATENT DOCUMENTS

GB 572089 A * 9/1945 ..... E21B 17/0426
WO WO 2015/187217 A1 12/2015

OTHER PUBLICATIONS

W. Raymond Cribb et al, "Performance Advances in Copper-Nickel-Tin Spinodal Alloys," Advanced Materials & Processes, Sep. 1, 2013, pp. 20-25.
International Search Report for PCT Application PCT/US2018/023385 dated Jun. 8, 2018.

* cited by examiner

Oscillating axial motion with side loading. Average bearing stress @ 2,000 psi. Carburized steel shaft.

COUPLINGS FOR WELL PUMPING COMPONENTS

CROSS-REFERENCE TO RELATED APPLICATIONS

This application is a continuation-in-part of U.S. patent application Ser. No. 14/633,593, filed Feb. 27, 2015, which claimed the benefit of U.S. Provisional Patent Application Ser. No. 62/008,324, filed Jun. 5, 2014.This application also claims priority to U.S. Provisional Patent Application Ser. No. 62/473,792, filed Mar. 20, 2017, the disclosure of which is fully incorporated by reference herein.

BACKGROUND

The present disclosure relates to couplings made from a spinodally-hardened copper alloy. The couplings are particularly useful for connecting components of a sucker rod string to a downhole pump. The alloys preferably have a sliding coefficient of friction of less than 0.4 when measured against carbon steel.

Hydrocarbon extraction apparatuses typically include a downhole pump for extracting hydrocarbons from an underground reservoir, a power source for providing power to the pump, and a sucker rod lift system connecting the power source and the downhole pump. The sucker rod lift system includes a series of sucker rods that are joined together by couplings. The rods and couplings are joined by a pin-and-box threaded connection. Additional couplings with threaded connections are also used when joining the sucker rod lift system to the downhole pump. Damage to threaded connections due to galling (wear due to adhesion between sliding surfaces) can compromise the mechanical integrity of the joint and lead to failure of the connection between the power source and the pump. In addition, the hydrocarbon extraction system operates within a conduit. Damage to the conduit and the coupling caused by repetitive contact between the outer surface of the couplings/pump and the inner surface of the conduit can compromise the mechanical integrity of the conduit or the coupling, leading either to leakage of the hydrocarbons carried by the conduit into the environment or separation of the coupling connection to the sucker rod string. Either event effectively stops the pumping process and often leads to very costly additional operations to remediate such failures.

Desired characteristics of couplings used in such systems include high tensile strength, high fatigue strength, high fracture toughness, galling resistance, and corrosion resistance. Conventional couplings are typically comprised of steel or nickel alloys which lack the full complement of preferred intrinsic characteristics, particularly galling resistance. Expensive surface treatments are typically used to increase wear resistance on couplings made from steel or nickel alloys, as well as on the inside of the conduit inside which the coupling is disposed. These surface treatments eventually wear off, and must be re-applied periodically over the course of the lifetime of the parts in order to be effective. Furthermore, while coatings may reduce wear of the component on which they are applied, the coatings are often incompatible with the other components of the system with which the coating may come into contact.

It would be desirable to develop new couplings having improved intrinsic galling resistance as well as other desirable properties such that the coupling and the conduit materials are compatible, meaning they both experience minimal wear during operation, do not require any protective coatings, and reduce the total frictional losses of the pumping system.

BRIEF DESCRIPTION

The present disclosure relates to couplings made from spinodally-hardened copper alloys, and more specifically a coupling that is inserted between the sucker rod of a sucker rod string and the valve rod bushing of a downhole pump. The couplings can be considered part of the sucker rod string. The couplings have a unique combination of properties including high tensile strength, high fatigue strength, high fracture toughness, galling resistance, and corrosion resistance. This combination of properties delays the occurrence of destructive damage to the couplings and other components in pump systems using such couplings (e.g., sucker rods and conduits), while providing mechanical functionality during hydrocarbon recovery operations. This also extends the useful service life of such components, significantly reducing the costs of equipment used to recover hydrocarbons.

Disclosed herein in various embodiments are couplings for a sucker rod string, comprising a core having a first end, a central portion, and a second end. The first and second end each have an end surface. The first end has a linear taper extending from the central portion inwards and ending at the first end surface. Put another way, the first end surface has a smaller diameter than the central portion. The second end surface of the second end has a rounded edge. The couplings are made from a spinodally-hardened copper-nickel-tin alloy having reduced friction and improved wear resistance.

The diameter of the first end surface may be less than a diameter of the second end surface. In some particular embodiments, a threaded bore runs entirely through the core from the first end to the second end. The threads of the bore may have a Rockwell C hardness (HRC) of about 20 to about 40.

The threaded bore at the first end can be adapted to couple with a valve rod bushing, which may be connected to a downhole pump. The first end surface can abut a shoulder portion of the valve rod bushing. An outer diameter of the coupling may be greater than an outer diameter of the valve rod bushing.

The threaded bore at the second end can be adapted to couple with a sucker rod of the sucker rod string. The second end surface can abut a shoulder portion of the sucker rod. An outer diameter of the coupling may be greater than an outer diameter of the sucker rod.

Also disclosed herein are sucker rod strings, comprising a sucker rod including an end having a pin with an external thread and a valve rod bushing including an end having a pin with an external thread. A coupling is also included, as described above. The threaded bore at the first end of the coupling is complementary with the external thread of the valve rod bushing, and the threaded bore at the second end of the coupling is complementary with the external thread of the sucker rod. The coupling comprises a spinodally-hardened copper-nickel-tin alloy.

Also disclosed herein are pump systems comprising a downhole pump, a power source for powering the downhole pump; and a rod string located between the downhole pump and the power source. The rod string comprises a sucker rod including an end having a pin with an external thread and a valve rod bushing including an end having a pin with an external thread. A coupling is also included which is as described above. The threaded bore at the first end of the coupling is complementary with the external thread of the valve rod bushing, and the threaded bore at the second end of the coupling is complementary with the external thread of the sucker rod. The coupling comprises a spinodally-hardened copper-nickel-tin alloy.

Also disclosed herein in various embodiments are couplings for a sucker rod string, comprising a core having a first end, a central portion, and a second end. The first and second end each have an end surface. The first end has a linear taper extending from the central portion inwards and ending at the first end surface. Put another way, the first end surface has a smaller diameter than the central portion. The second end also has a linear taper extending from the central portion inwards and ending at the second end surface. Put another way, the second end surface has a smaller diameter than the central portion. The couplings are made from a spinodally-hardened copper-nickel-tin alloy.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
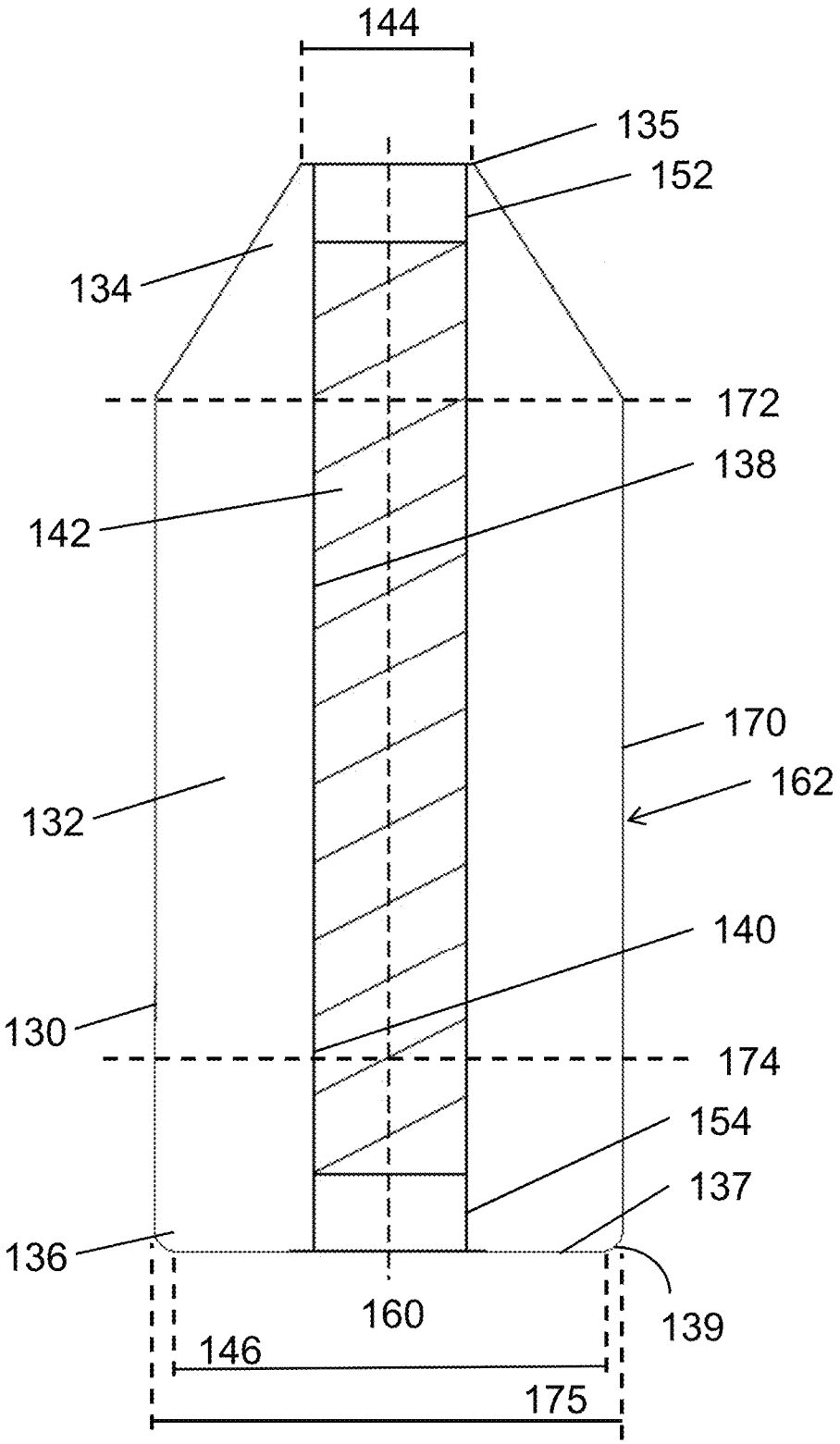
FIG. 1 is a side cross-sectional view of an exemplary sucker coupling of the present disclosure, having a linear taper on one end and a rounded edge on the other end.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named components/steps and permit the presence of other components/steps. However, such description should be construed as also describing compositions or processes as "consisting of" and "consisting essentially of" the enumerated components/steps, which allows the presence of only the named components/steps, along with any impurities that might result therefrom, and excludes other components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The present disclosure relates to couplings that are made from a spinodally strengthened copper-based alloy. The copper alloys of the present disclosure may be copper-nickel-tin alloys that have a combination of strength, ductility, high strain rate fracture toughness, and galling protection. More particularly, the couplings are contemplated to be artificial lift couplings, sucker rod couplings, or subcouplings used in the oil and gas industry, particularly for hydrocarbon recovery systems.

In particular, the sucker couplings of the present disclosure are contemplated to be used to join the downhole pump to the sucker rod string. A typical downhole pump has a plunger that is reciprocated inside of a pump barrel by the sucker rod string. The plunger and the barrel include a standing valve and a travelling valve. The plunger is connected to a pump drive rod or valve rod, which is in turn connected to a valve rod bushing, which is connected to the sucker rod string through the sucker coupling.

Figure 3A:
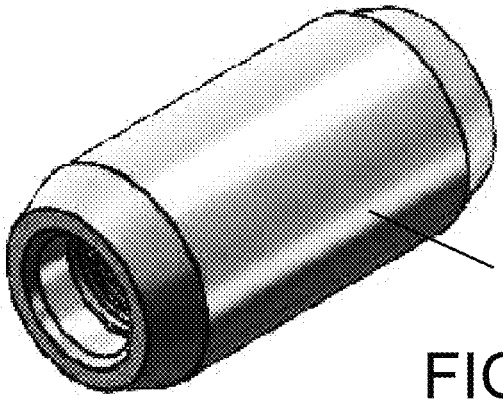
FIG. 3A is a picture of an exemplary sucker coupling of the present disclosure, having a linear taper on both ends.
Figure 3B:
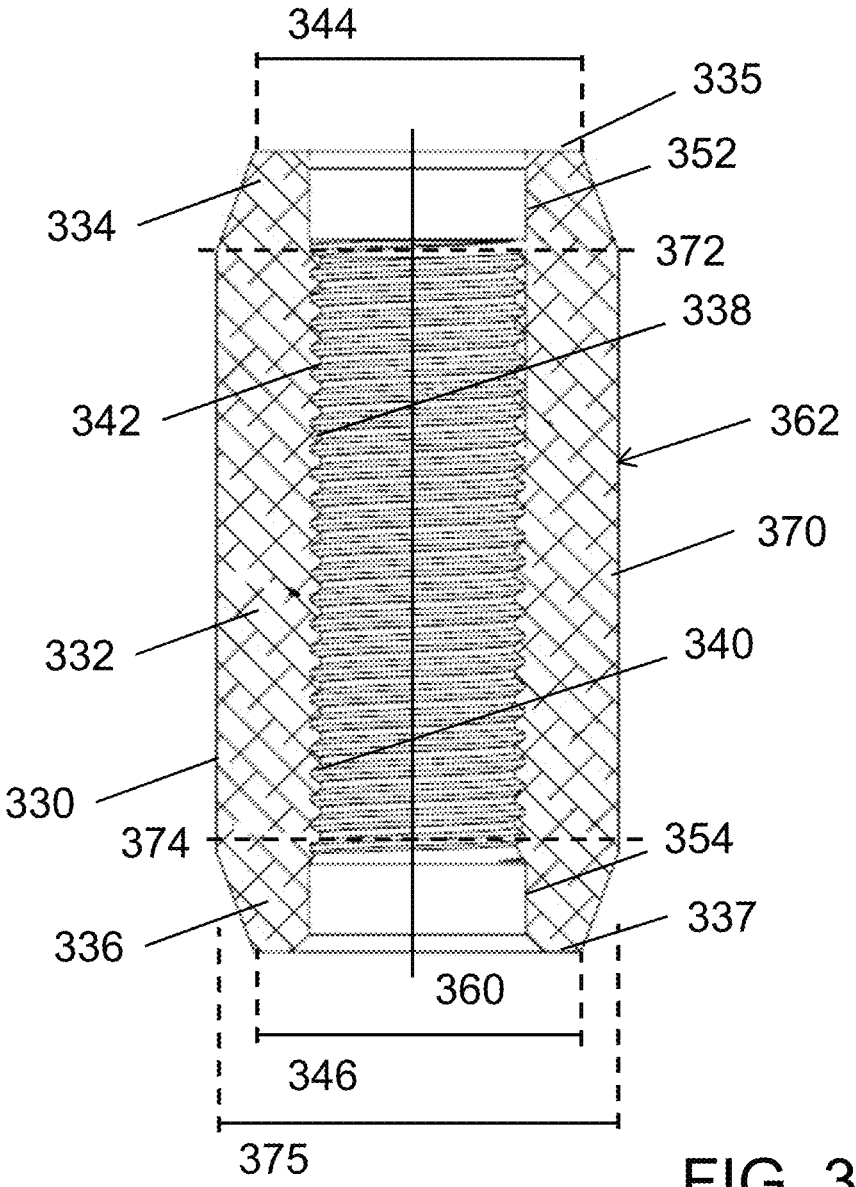
FIG. 3B is a side cross-sectional view showing the interior of the sucker coupling of FIG. 3A.

A sucker coupling 130 according to the present disclosure is illustrated in FIG. 1. The sucker rod coupling is used to assemble various components of a sucker rod string. For example, sucker coupling 130 may be used to couple a sucker rod 210 and a valve rod bushing 220 as shown in FIG. 3A and FIG. 3B and described below.

The sucker coupling 130 itself is a core 132 having a first end 134, a central portion 170, and a second end 136, each end corresponding to a box and having an internal thread (i.e. a female connector) 138, 140 for engaging the pin of another component in the sucker rod string. The core has a generally cylindrical shape, with the length being greater than the diameter. Dotted lines 172, 174 indicate where the central portion 170 joins the first end 134 and the second end 136. The central portion 170 has outer diameter 175.

The first end 134 has a first end surface 135. The first end 134 has a linear taper extending inwards toward the end surface 135. In other words, the first end 134 is chamfered. Alternatively, the first end surface 135 can be described as having a smaller diameter 144 than the diameter 175 of the central portion 170. The term "taper" here refers only to the diameter decreasing from the middle to each end, and does not require the change in diameter to occur in any given manner. Here, the taper is linear, i.e. in a straight line.

The second end 136 has a second end surface 137. The second end 136 has a rounded edge 139 which transitions into the end surface 137. The second end surface 137 thus has a diameter 146 which is less than the diameter 175 of the central portion 170, but greater than the diameter 144 of the first end surface 135. In particular embodiments, the second end surface diameter 146 is at least one-quarter inch greater than the first end surface diameter 144. In some specific embodiments, the first end surface diameter 144 is one and five-eighths inches, the second end surface diameter 146 is about 1.9 inches, and the diameter 175 of the central portion is 2 inches.

A bore 142 runs entirely through the core from the first end 134 to the second end 136 along the longitudinal axis 160 of the core. Both internal threads 138, 140 are located on the surface of the bore. Here, both internal threads have the same box thread size, and are complementary to the external threads on other components of the sucker rod string which may be coupled by the coupling 130.

As further shown in the cross-sectional view provided by FIG. 1, the sucker coupling 130 includes a counterbore 152, 154 at each end surface 135, 137. Put another way, the internal thread does not run all the way to the end surface. The longitudinal axis is also indicated by line 160. The sucker coupling 130 has a substantially smooth cylindrically curved exterior surface 162 between the end surfaces 134, 136. In other words, the outer diameter remains constant along the length of the central portion 170. The outer diameter then decreases at the tapered first end 134 and the rounded edge of second end 136.

Figure 2A:
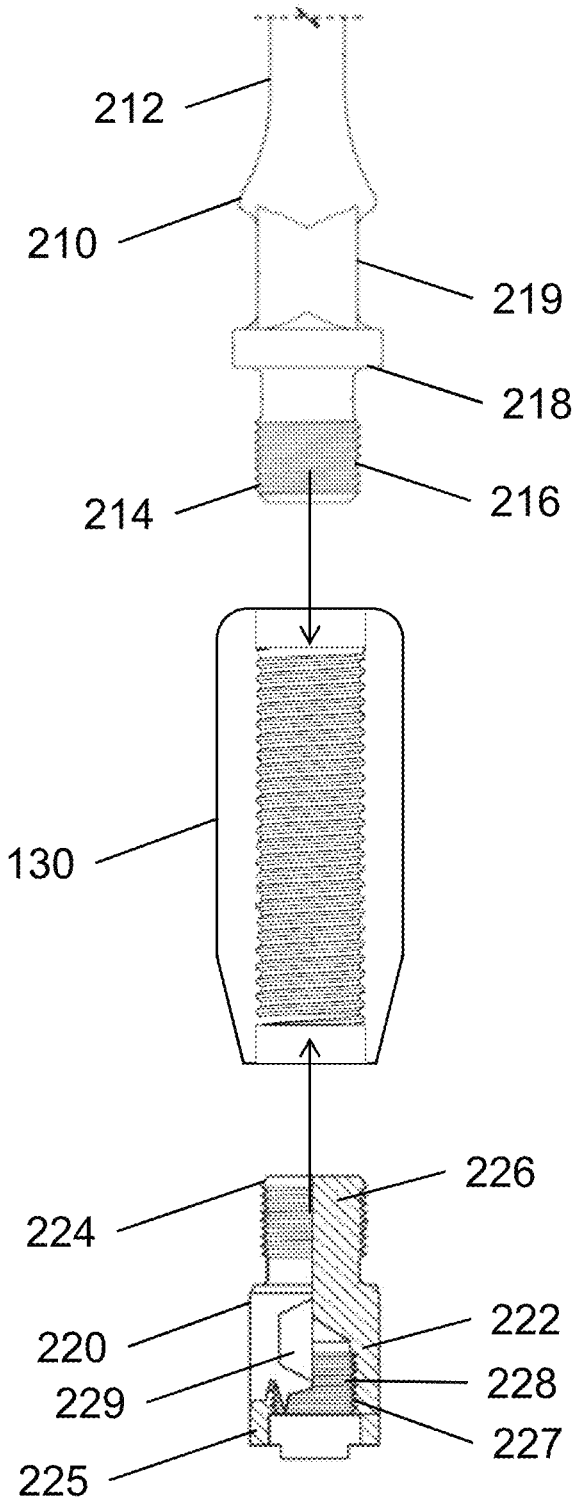
FIG. 2A is a partial cross-sectional view showing the engagement of a sucker coupling with a sucker rod and a valve rod bushing that is connected to a downhole pump.
Figure 2B:
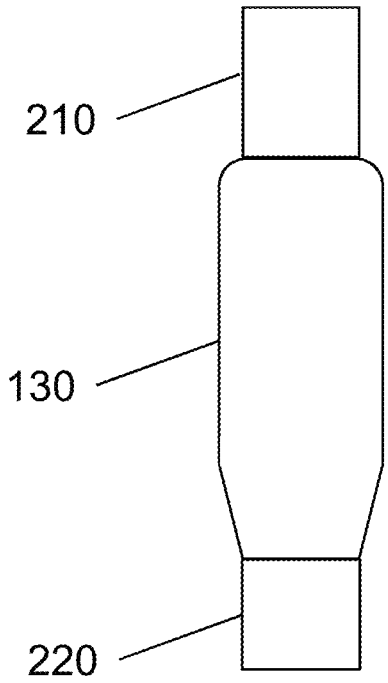
FIG. 2B is a side view showing the coupling, sucker rod, and valve rod bushing of FIG. 2A in an assembled condition.

FIG. 2A and FIG. 2B are side views illustrating the engagement between two components of a sucker rod string with a coupling of the present disclosure. FIG. 2A is an exploded, partial cross-section view showing a sucker or stabilizer rod 210 and a valve rod bushing 220 that are coupled together via sucker coupling 130. FIG. 2A and FIG. 2B illustrate the use of a coupling having the geometry of sucker coupling 130 described above and shown in FIG. 1.

The sucker or stabilizer rod 210 includes a rod body 212 and two rod ends (only rod end 214 is shown). The rod end 214 includes an externally-threaded pin (or male connector) 216; a shoulder 218 adapted to abut the end surface of the coupling; and a drive head 219 which can be engaged by a tool for torqueing and tightening stabilizer rods. The valve rod bushing 220 includes a bushing body 222 and two bushing ends 224, 225. The valve rod bushing includes an externally-threaded pin (or male connector) 226 at the first bushing end 224, and a counterbore 227 at the second bushing end 224. A shoulder 221 is present between the two bushing ends 224, 225. The counterbore 227 has internal threads 228 (i.e. a female connector) located on the surface of the counterbore for engaging the pin of another component in the sucker rod string. A drive head 229 is also included, which can be engaged by a tool for torqueing and tightening the valve rod bushing.

FIG. 2B shows the components of FIG. 2A in assembled form. That is, the male connector of the stabilizer rod 210 is mated with the female connector at the second end of the sucker coupling 130, and the male connector of the valve rod bushing 220 is mated with the female connector at the first end of the sucker rod coupling 130. FIG. 2B illustrates that the outer diameter of the coupling can be greater than the outer diameter of the rod string components to which the couplings attach, such as the stabilizer rod 210 and the valve rod bushing 220. This prevents the coupled rod string components from contacting the production tubing (i.e. conduit 411 of FIG. 4) surrounding the rod string. In addition, the ends of the valve rod bushing and the stabilizer rod are screwed into the coupling until the coupling abuts the shoulder 218, 221.

An additional variation of a sucker coupling 330 according to the present disclosure is shown in FIG. 3A and FIG. 3B. FIG. 3A is a picture of a sucker coupling 330 for assembling various components of a sucker rod string. FIG. 3B is a cross-sectional view of the sucker rod coupling 330 pictured in FIG. 3A.

Here, the sucker coupling 330 itself is a core 332 having a first end 334, a central portion 370, and a second end 336, each end corresponding to a box and having an internal thread (i.e. a female connector) 338, 340 for engaging the pin of another component in the sucker rod string. The core has a generally cylindrical shape, with the length being greater than the diameter. Dotted lines 372, 374 indicate where the central portion 370 joins the first end 334 and the second end 336. The central portion 370 has outer diameter 375.

The first end 334 has a first end surface 335. The first end 334 has a linear taper extending inwards toward the end surface 335. In other words, the first end 334 is chamfered. Alternatively, the first end surface 335 can be described as having a smaller diameter 344 than the diameter 375 of the central portion 370.

The second end 336 has a second end surface 337. The second end 336 also has a linear taper extending inwards toward the end surface 337. In other words, the second end 336 is also chamfered. Alternatively, the second end surface 337 can be described as having a smaller diameter 346 than the diameter 375 of the central portion 370. In specific embodiments, the first end surface diameter 344 is about the same as the second end surface diameter 346, both of which are less than the central portion outer diameter 375. In some specific embodiments, the first end surface diameter 344 and the second end surface diameter 346 are each one and five-eighths inches, and the diameter 375 of the central portion is 2 inches.

As illustrated here, a bore 342 runs entirely through the core from the first end 334 to the second end 336 along the longitudinal axis of the core. Both internal threads 338, 340 are located on the surface of the bore. Here, both internal threads have the same box thread size, and are complementary to the external threads on other components of the sucker rod string which may be coupled by the coupling 330. The dimensions of the sucker rods and the various parts of the sucker rod coupling are defined by API Specification 11B, the 27th edition of which was issued in May 2010.

As further shown in the cross-sectional view provided by FIG. 3B, the sucker coupling 330 includes a counterbore 352, 354 at each end surface 335, 337. Put another way, the internal thread does not run all the way to the end surface. The longitudinal axis is also indicated by line 360. The sucker coupling 330 has a substantially smooth cylindrically curved exterior surface 362 along the central portion 370 of the coupling. The outer diameter then decreases at the chamfered end portions 334, 336. The central outer diameter of these couplings can be greater than the outer diameter of the rod string components to which the couplings attach, such as stabilizer rods or valve rod bushings. This prevents the coupled rod string components from contacting the production tubing (i.e. conduit 411 of FIG. 4) surrounding the rod string.

Figure 4:
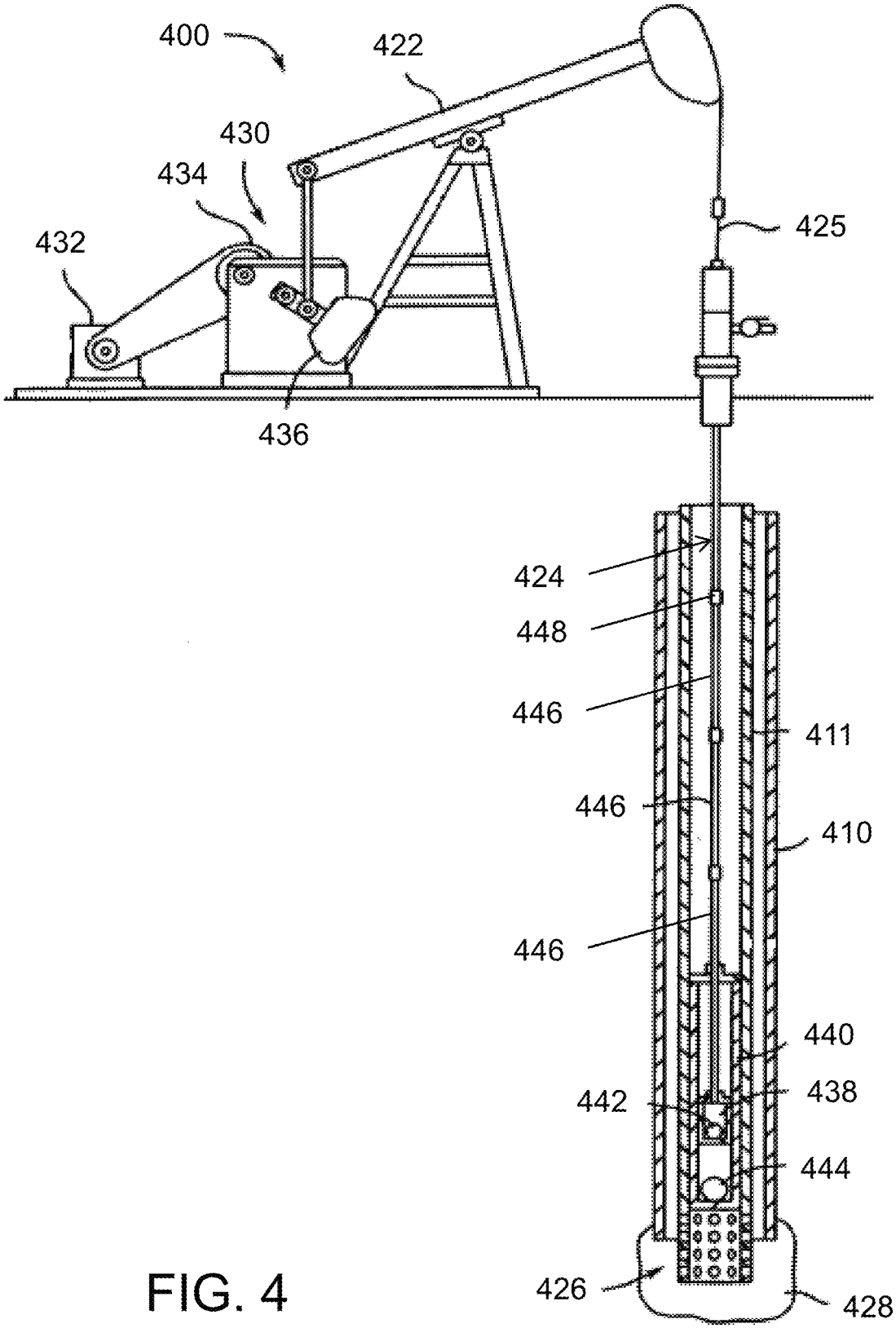
FIG. 4 is a schematic illustration of an embodiment of a pumping system of the present disclosure.

FIG. 4 illustrates the various parts of a pump system 400 which utilizes various rod string components described above, such as the sucker couplings. The system 400 has a walking beam 422 that reciprocates a rod string 424 that includes a polished rod portion 425. The rod string 224 is suspended from the beam for actuating a downhole pump 426 that is disposed at the bottom of a well 428.

The walking beam 422, in turn, is actuated by a pitman arm which is reciprocated by a crank arm 430 driven by a power source 432 (e.g., an electric motor) that is coupled to the crank arm 430 through a gear reduction mechanism, such as gearbox 434. The power source may be a three-phase AC induction motor or a synchronous motor, and is used to drive the pumping unit. The gearbox 434 converts motor torque to a low speed but high torque output for driving the crank arm 430. The crank arm 430 is provided with a counterweight 436 that serves to balance the rod string 424 suspended from the beam 422. Counterbalance can also be provided by an air cylinder such as those found on air-balanced units. Belted pumping units may use a counterweight that runs in the opposite direction of the rod stroke or an air cylinder for counterbalance.

The downhole pump 426 may be a reciprocating type pump having a plunger 438 attached to the end of the rod string 424 and a pump barrel 440 which is attached to the end of tubing in the well 428. The plunger 438 includes a traveling valve 442 and a standing valve 444 positioned at the bottom of the barrel 440. On the up stroke of the pump, the traveling valve 442 closes and lifts fluid, such as oil and/or water, above the plunger 438 to the top of the well and the standing valve 444 opens and allows additional fluid from the reservoir to flow into the pump barrel 440. On the down stroke, the traveling valve 442 opens and the standing valve 444 closes in preparation of the next cycle. The operation of the pump 426 is controlled so that the fluid level maintained in the pump barrel 440 is sufficient to maintain the lower end of the rod string 424 in the fluid over its entire stroke. The rod string 424 is surrounded by a conduit 411 which in turn is surrounded by a well casing 410. The rod string 424 below the polished rod portion 425 is made of sucker or stabilizer rods 446 that are held together via couplings 448. Couplings 448 may include the sucker couplings (e.g., 130, 230) and valve rod bushings (e.g., 320) described above.

The connection between the sucker rod and the valve rod bushing is one of the most problematic joints in the sucker rod string. Conventional coupling geometries and materials cause rapid tubing wear due to contact between surfaces combined with the elevated velocity of the well fluid as it exits the pump and flows through the clearance between the production tubing and the coupling between the valve rod bushing and the stabilizer rod. The use of the copper alloys disclosed herein as the material for the couplings of the present disclosure reduces damage to threaded connections due to galling-type wear between coupling and tubing. Moreover, the geometry (e.g., chamfered or rounded ends, large outer diameters) of the presently disclosed couplings prevents high energy contact between the coupling and the inner diameter of the tubing due to misalignment. That is, conventional couplings include sharp edges which are more like to damage components in the event of a high energy contact. Moreover, the geometry of the presently disclosed couplings facilitates the flow of well fluids into the diametrical clearance between the coupling and the tubing.

Additionally, the couplings of the present disclosure, being made from the copper alloys disclosed herein, enable the couplings to act as a dampening device. The dampening is enabled because the copper alloys disclosed herein have a low elastic modulus compared to conventional materials. The dampening allows for the absorption of more energy as the lower face of the valve rod bushing (e.g., bushing end 325 in FIG. 3A) impacts other components of the sucker rod string during downward stroke of the pump. This phenomenon reduces the tendency of the mating surface of the upper components of the pump to become heavily cold worked during service. Such cold working can lead to loss of ductility and eventually to cracking, as well as the formation of "extruded" metal protrusions extending outward beyond the as-installed diameter of these components. These protrusions damage the inner diameter of the tubing and the production barrel of the pump. Metal fragments may be created as the protrusions fracture. These fragments can cause severe damage to the working surfaces of the pump and the tubing because they remain the system. The high modulus of resistance of the copper alloys disclosed herein enables the coupling to perform this dampening function without plastically deforming. Rather, the coupling is able to return to its original dimensions after both compression on the downward stroke and tension in the upstroke. In other words, the coupling acts as a solid spring.

Generally, the copper alloy used to form the couplings of the present disclosure has been cold worked prior to reheating to affect spinodal decomposition of the microstructure. Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

The copper-nickel-tin alloy utilized herein generally includes from about 9.0 wt % to about 15.5 wt % nickel, and from about 6.0 wt % to about 9.0 wt % tin, with the remaining balance being copper. This alloy can be hardened and more easily formed into high yield strength products that can be used in various industrial and commercial applications. This high performance alloy is designed to provide properties similar to copper-beryllium alloys.

More particularly, the copper-nickel-tin alloys of the present disclosure include from about 9 wt % to about 15 wt % nickel and from about 6 wt % to about 9 wt % tin, with the remaining balance being copper. In more specific embodiments, the copper-nickel-tin alloys include from about 14.5 wt % to about 15.5% nickel, and from about 7.5 wt % to about 8.5 wt % tin, with the remaining balance being copper.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

The copper alloy may include beryllium, nickel, and/or cobalt. In some embodiments, the copper alloy contains from about 1 to about 5 wt % beryllium and the sum of cobalt and nickel is in the range of from about 0.7 to about 6 wt %. In specific embodiments, the alloy includes about 2 wt % beryllium and about 0.3 wt % cobalt and nickel. Other copper alloy embodiments can contain a range of beryllium between approximately 5 and 7 wt %.

In some embodiments, the copper alloy contains chromium. The chromium may be present in an amount of less than about 5 wt % of the alloy, including from about 0.5 wt % to about 2.0 wt % or from about 0.6 wt % to about 1.2 wt % of chromium.

In some embodiments, the copper alloy contains silicon. The silicon may be present in an amount of less than 5 wt %, including from about 1.0 wt % to about 3.0 wt % or from about 1.5 wt % to about 2.5 wt % of silicon.

The alloys of the present disclosure optionally contain small amounts of additives (e.g., iron, magnesium, manganese, molybdenum, niobium, tantalum, vanadium, zirconium, and mixtures thereof). The additives may be present in amounts of up to 1 wt %, suitably up to 0.5 wt %. Furthermore, small amounts of natural impurities may be present. Small amounts of other additives may be present such as aluminum and zinc. The presence of the additional elements may have the effect of further increasing the strength of the resulting alloy.

In some embodiments, some magnesium is added during the formation of the initial alloy in order to reduce the oxygen content of the alloy. Magnesium oxide is formed which can be removed from the alloy mass.

In particular embodiments, the internal threads of the coupling are formed by roll forming, rather than by cutting. This process appears to elongate the grains on the outer surface of the threads. Rolled threads have been found to resist stripping because shear failures must take place across the grain, rather than with the grain. This cold working process also provides additional strength and fatigue resistance. As a result, the internal threads may have a Rockwell C hardness (HRC) of about 20 to about 40. The HRC can vary throughout the thread, and this recitation should not be construed as requiring the entire thread to have the same HRC. In particular embodiments, the HRC of the thread is a minimum of 22. The outer surface of the thread may have an HRC of at least 35.

The alloys used for making the couplings of the present disclosure may have a 0.2% offset yield strength of at least 75 ksi, including at least 85 ksi, or at least 90 ksi, or at least 95 ksi.

The alloys used for making the couplings of the present disclosure may have a combination of 0.2% offset yield strength and room temperature Charpy V-Notch impact energy as shown below in Table 1. These combinations are unique to the copper alloys of this disclosure. The test samples used to make these measurements were oriented longitudinally. The listed values are minimum values (i.e. at least the value listed), and desirably the offset yield strength and Charpy V-Notch impact energy values are higher than the combinations listed here. Put another way, the alloys have a combination of 0.2% offset yield strength and room temperature Charpy V-Notch impact energy that are equal to or greater than the values listed here.

TABLE 1

| 0.2% Offset Yield Strength (ksi) | Ultimate Tensile Strength (ksi) | Elongation at break (%) | Room Temperature Charpy V-Notch Impact Energy (ft-lbs) | Preferred Room Temperature Charpy V-Notch Impact Energy (ft-lbs) |
|---|---|---|---|---|
| 120 | 120 | 15 | 12 | 15 |
| 102 | 120 | 15 | 12 | 20 |
| 95 | 106 | 18 | 22 | 30 |

Table 2 provides properties of another exemplary embodiment of a copper-based alloy suitable for the present disclosure for use in a sucker rod coupling or subcoupling.

TABLE 2

| | 0.2% Offset Yield Strength (ksi) | Ultimate Tensile Strength (ksi) | Elongation at break (%) | Charpy V-Notch Impact Energy (ft-lbs) |
|---|---|---|---|---|
| Average | 161 | 169 | 6 | N/A |
| Minimum | 150 | 160 | 3 | N/A |

The 0.2% offset yield strength and ultimate tensile strength are measured according to ASTM E8. The CVN toughness is measured according to ASTM E23. The rod couplings of the present disclosure can be made using casting and/or molding techniques known in the art.

The couplings made of the spinodally-decomposed copper alloys uniquely have high tensile and fatigue strength in combination with high fracture toughness, galling resistance, and corrosion resistance. The unique combination of properties allows the couplings to satisfy basic mechanical and corrosion characteristics needed while reliably protecting system components from galling damage, thereby greatly extending the lifetime of the system and reducing the risk of unanticipated failure. One result is longer well life between maintenance shutdowns. In addition, overall production is enhanced due to the reduced friction.

Some copper-nickel-tin alloys of the present disclosure have a low sliding coefficient of friction. In some embodiments, the copper-nickel-tin alloy in contact with carbon steel, has a sliding coefficient of friction of less than 0.4. In other embodiments, the copper-nickel-tin alloy has a sliding coefficient of about 0.3 or less, including about 0.2 or less.

Figure 5:
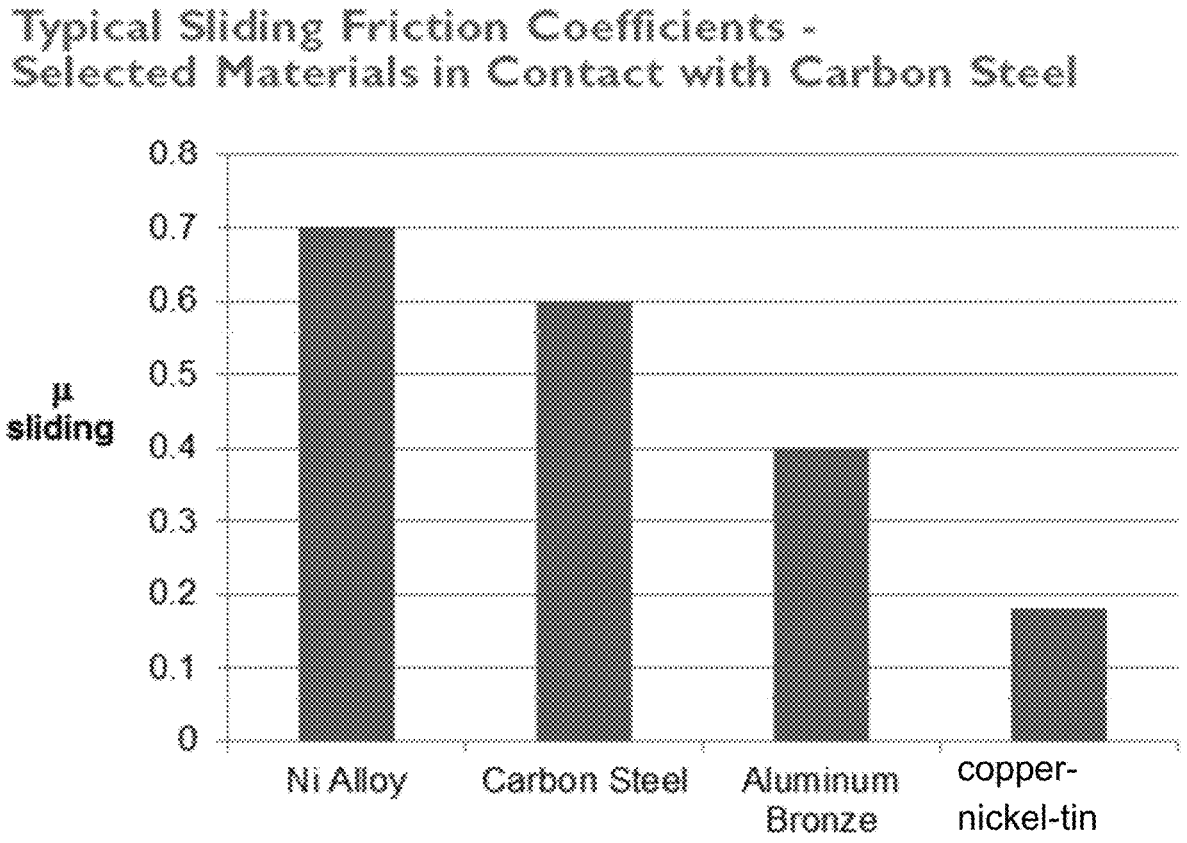
FIG. 5 is a graph illustrating typical sliding friction coefficients of various materials measured by sliding the material on carbon steel. The y-axis is dimensionless and runs from 0 to 0.8 at intervals of 0.1. From left to right, the materials are nickel alloy, carbon steel, aluminum bronze, and copper-nickel-tin.

In particular embodiments of the present disclosure, a copper-nickel-tin alloy in contact with carbon steel typically has a sliding coefficient of less than 0.2 (including about 0.175 or less). In contrast, a nickel alloy in contact with carbon steel typically has a sliding coefficient of friction of 0.7. Carbon steel in contact with carbon steel typically has a sliding coefficient of 0.6 and aluminum bronze in contact with carbon steel typically has a sliding coefficient of 0.4. The comparison of these values are illustrated in the graph of FIG. 5. Thus, it is possible to significantly reduce overall frictional losses in the pumping system.

Figure 6:
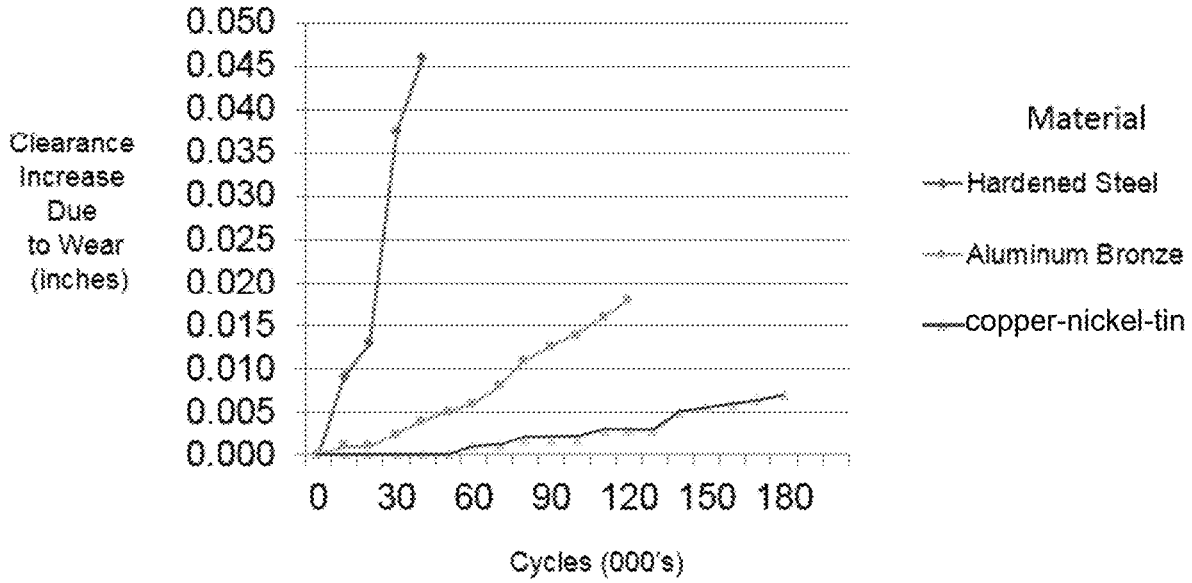
FIG. 6 is a graph illustrating the wear of various materials against a steel shaft. The y-axis is the clearance increase due to wear, in inches. The y-axis runs from 0.000 to 0.050 at intervals of 0.005. The x-axis is the number of wear cycles, in thousands, and runs from 0 to 180 at intervals of 30. The steepest line is for hardened steel, and the shallowest line is for copper-nickel-tin.

The reduction in friction also results in less tubing wear. FIG. 6 is a graph showing the use of three different metals used in bearings in contact with a carburized steel shaft with an average bearing stress at 2,000 psi, and oscillating axial motion with side loading. The y-axis indicates the change in clearance due to wear, with a lower value indicating less wear. As seen here, the copper-nickel-tin alloy wore less (triangles, below 0.010 inches) than aluminum bronze (squares, between 0.015 and 0.020 inches) and hardened steel (diamonds, more than 0.045 inches).

The following examples are provided to illustrate the couplings, processes, and properties of the present disclosure. The examples are merely illustrative and are not intended to limit the disclosure to the materials, conditions, or process parameters set forth therein.

EXAMPLES

Example 1

Sucker rod couplings made of Cu-15Ni-8Sn alloys were used on rod strings in selected trial wells with L80 carbon steel production tubing (HRC 22-23 hardness). Mean run time before failure (MTBF) for steel couplings was approximately 10 months. When the Cu15Ni8Sn couplings were installed, the MTBF increased five-fold. No evidence of wear or metal transfer was found in inspected Cu15Ni8Sn couplings.

One well was shut down 555 days after the Cu15Ni8Sn couplings were installed due to a pump leak. The tubes used to form the well casing were inspected. 50% of tubes that used steel couplings had ≥30% wall loss, whereas 0% of tubes that used the Cu15Ni8Sn couplings had ≥30% wall loss. 25% of tubes that used steel couplings had ≥30% surface pitting, whereas 0% of tubes that used the Cu15Ni8Sn couplings had ≥30% surface pitting. It was calculated that this would increase MTBF of the tubing by at least three (3) times.

Example 2

55 Cu15Ni8Sn couplings were installed in the bottom 1,400 feet of a well. The following information was captured:

TABLE 4

| | Prior Practice | Cu15Ni8Sn Actual |
|---|---|---|
| Rod/coupling drag coefficient | 0.2 | 0.035 |
| Pump stroke (inches) | 141 | 151 |
| Liquid production (barrels per day) | 233 | 248 |
| Polished rod load (pounds) | 33,000 | 31,570 |

The result of Cu15Ni8Sn coupling use was a 6.4% increase in liquid production. Results for similar experiments showed production increases of 9%, maximum load decrease of 12%, and increased pump stroke of 21%.

It is thus expected that pump stroke increases of about 3% up to about 40%, or about 6% to about 40%, or about 6% to about 30%, or about 3% to about 10%, or about 6% to about 10% should occur due to the use of these copper-nickel-tin alloys (compared to the use of steel).

Example 3

Figure 7:
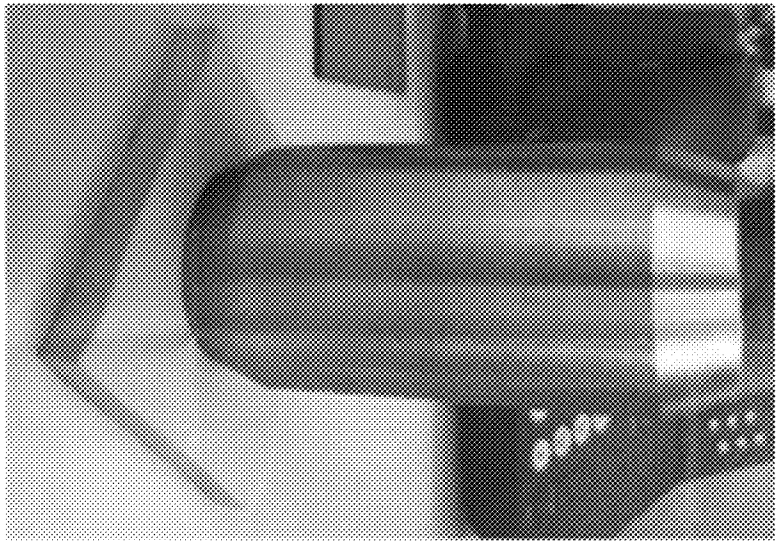
FIG. 7 is a picture of a sucker coupling of the present disclosure, made from a Cu-15Ni-8Sn alloy.

A coupling was made of Cu15Ni8Sn alloy. The coupling is depicted in FIG. 7, and has a cross-section as illustrated in FIG. 3B. The tapered coupling has an outer diameter of two (2) inches with ¾-inch rolled threads. The coupling is joined to a valve rod bushing, and acts as a centralizer so that the valve rod bushing does not wear out adjacent tubing.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A sucker rod string, comprising:

a sucker rod including an end having a pin with an external thread;

a valve rod bushing including a first end having a pin with an external thread and a second end having a counterbore with an internal thread, wherein the valve rod bushing connects to a downhole pump; and a coupling comprising a core having a first end, a central portion, and a second end, the first end and the second end each having an end surface, wherein the first end tapers linearly inwards from the central portion to the first end surface; and wherein the coupling is made from a spinodally-hardened copper-nickel-tin alloy that has a sliding coefficient of friction of 0.175±10% to less than 0.4 when measured against carbon steel, and wherein a threaded bore runs entirely through the core from the first end to the second end;

wherein the threaded bore at the first end of the coupling is complementary with the external thread of the valve rod bushing, and the threaded bore at the second end of the coupling is complementary with the external thread of the sucker rod.

2. The sucker rod string of claim 1, wherein the second end surface has a rounded edge, or wherein the second end tapers linearly inwards from the central portion to the second end surface.

3. The sucker rod string of claim 1, wherein an outer diameter of the sucker rod is greater than an outer diameter of the valve rod bushing.

4. The sucker rod string of claim 1, wherein an outer diameter of the coupling is greater than both an outer diameter of the sucker rod and an outer diameter of the valve rod bushing.

5. The sucker rod string of claim 1, wherein the first end surface abuts a shoulder portion of the valve rod bushing.

6. The sucker rod string of claim 1, wherein the second end surface abuts a shoulder portion of the sucker rod.

7. The sucker rod string of claim 1, wherein the alloy comprises from 8 to 20 wt % nickel, and from 5 to 11 wt % tin, the remaining balance being copper, wherein the alloy has a 0.2% offset yield strength of 75 ksi to 150 ksi.

8. The sucker rod string of claim 1, wherein the alloy comprises 14.5 wt % to 15.5 wt % nickel, and 7.5 wt % to 8.5% tin, the remaining balance being copper.

9. The sucker rod string of claim 1, wherein the alloy has a 0.2% offset yield strength of 95 ksi to 150 ksi and a Charpy V-notch impact energy of 22 ft-lbs to 30 ft-lbs at room temperature.

10. A coupling for a sucker rod string, comprising:

a core having a first end, a central portion, and a second end, the first end and the second end each having an end surface, wherein (A) the first end tapers linearly inwards from the central portion to the first end surface, and (B) the second end surface has a rounded edge, and (C) wherein a diameter of the first end surface is less than a diameter of the second end surface; and wherein the coupling is made from a spinodally-hardened copper-nickel-tin alloy and has a sliding coefficient of friction of 0.175±10% to less than 0.4 when measured against carbon steel.

11. The coupling of claim 10, further comprising a threaded bore running entirely through the core from the first end to the second end.

12. The coupling of claim 11, wherein the threads of the bore have a Rockwell C hardness (HRC) of 20±10% to 40±10%.

13. The coupling of claim 10, where the first end and the second end each also includes a counterbore.

14. The coupling of claim 10, wherein the alloy has a 0.2% offset yield strength of 75 ksi to 150 ksi.

15. The coupling of claim 10, wherein the alloy comprises 14.5 wt % to 15.5 wt % nickel, and 7.5 wt % to 8.5% tin, the remaining balance being copper.

16. The coupling of claim 10, wherein the alloy has a 0.2% offset yield strength of 85 ksi to 150 ksi.

17. The coupling of claim 10, wherein the alloy has a 0.2% offset yield strength of 95 ksi to 150 ksi and a Charpy V-notch impact energy of 22 ft-lbs to 30 ft-lbs at room temperature.

18. A method of extracting a fluid from a well, comprising:

operatively connecting a downhole pump to a motor using a sucker rod string; and operating the downhole pump using the sucker rod string to extract fluid from the well;

wherein the downhole pump includes a valve rod bushing including a first end having a pin with an external thread and a second end having a counterbore with an internal thread;

wherein a sucker coupling connects the valve rod bushing to the sucker rod string; and wherein the sucker coupling comprises:

a core having a first end, a central portion, and a second end, the first end and the second end each having an end surface, wherein (A) the first end tapers linearly inwards from the central portion to the first end surface, and (B) either (i) the second end surface has a rounded edge or (ii) the second end tapers linearly inwards from the central portion to the second end surface; and wherein the coupling is made from a spinodally-hardened copper-nickel-tin alloy and has a sliding coefficient of friction of 0.175±10% to less than 0.4 when measured against carbon steel.

19. The method of claim 18, wherein a mean time between failure (MTBF) of the sucker coupling is three to five times greater than the MTBF of a coupling made from L80 carbon steel.

20. A pump system comprising:

a downhole pump;

a power source for powering the downhole pump; and a rod string located between the downhole pump and the power source;

wherein the rod string comprises:

a sucker rod including an end having a pin with an external thread;

a valve rod bushing including a first end having a pin with an external thread and a second end having a counterbore with an internal thread, the valve rod bushing being connected to the downhole pump;

a coupling comprising a core having a first end, a central portion, and a second end, the first end and the second end each having an end surface, wherein the first end tapers linearly inwards from the central portion to the first end surface, and either (i) the second end surface has a rounded edge or (ii) the second end tapers linearly inwards from the central portion to the second end surface; and wherein the coupling is made from a spinodally-hardened copper-nickel-tin alloy that has a sliding coefficient of friction of 0.175±10% to less than 0.4 when measured against carbon steel, and wherein a threaded bore runs entirely through the core from the first end to the second end;

wherein the threaded bore at the first end of the coupling is complementary with the external thread of the valve rod bushing, and the threaded bore at the second end of the coupling is complementary with the external thread of the sucker rod.

* * * * *